US005430245A

United States Patent [19]

Rogers

[11] Patent Number: 5,430,245

[45] Date of Patent: Jul. 4, 1995

[54] ELECTROACOUSTICAL DRUM

[75] Inventor: Thomas P. Rogers, Englewood, N.J.

[73] Assignee: RTOM Corporation, Englewood, N.J.

[21] Appl. No.: 132,518

[22] Filed: Oct. 6, 1993

Related U.S. Application Data

[63] Continuation-in-part of Ser. No. 4,712, Jan. 14, 1993.

[51] Int. Cl.[6] ..... G10H 3/14

[52] U.S. Cl. ..... 84/725; 84/743

[58] Field of Search ..... 84/723, 725, 743

[56] References Cited

U.S. PATENT DOCUMENTS

| | | | |
|---|---|---|---|
| 3,509,264 | 4/1970 | Green | 84/1.15 |
| 3,553,339 | 1/1971 | Dominguez et al | 84/1.15 |
| 3,956,959 | 5/1976 | Ebihara et al. | 84/1.15 |
| 4,168,646 | 9/1979 | May | 84/DIG. 12 X |
| 4,201,107 | 5/1980 | Barber, Jr. et al. | 84/DIG. 12 X |
| 4,242,937 | 1/1981 | Pozar | 84/DIG. 12 X |
| 4,416,181 | 11/1983 | Hartry et al. | 84/272 |
| 4,669,349 | 6/1987 | Hyakutake | 84/1.14 |
| 4,837,836 | 6/1989 | Barcus . | |
| 4,947,725 | 8/1990 | Nomura | 84/723 |
| 4,984,498 | 1/1991 | Fishman | 84/730 |
| 5,042,356 | 8/1991 | Karch | 84/725 |
| 5,056,403 | 10/1991 | Yamashita | 84/723 |

FOREIGN PATENT DOCUMENTS

| | | |
|---|---|---|
| 964362 | 3/1975 | Canada . |
| WO90/03639 | 4/1990 | WIPO . |

*Primary Examiner*—William M. Shoop, Jr.
*Assistant Examiner*—Jeffrey W. Donels
*Attorney, Agent, or Firm*—Fish & Richardson

[57] ABSTRACT

An electroacoustical drum has a drum shell and a drum head having an outside surface and an inside surface. A fastening assembly secures the drum head to the drum shell with the drum head in tension. A transducer has a vibratable surface, so that vibration of the vibratable surface produces a corresponding electrical signal from the voice coil. Striking the outer surface of the drum head with a drumstick produces a corresponding electrical signal from the transducer, while allowing a musician striking the drum head outer surface with the drumsticks to perceive substantially the same feel perceived by correspondingly striking an acoustic drum.

50 Claims, 11 Drawing Sheets

ELECTROACOUSTICAL DRUM

This application is a continuation-in-part of copending application U.S. Ser. No. 08/004,712, filed Jan. 14, 1993.

This invention relates to drum head transducing.

A search of subclasses 104, 171, 411A, 411R, 723, 725 and 730 of class 81 uncovered U.S. Pat. Nos. 3,509,264, 3,553,339, 3,956,959, 4,669,349, 4,947,725, 4,984,498, 5,042,356, 5,056,403, PCT W090/03639 and Canadian Patent No. 964,362.

According to the invention, a drum has either a pretuned or a tunable drum head maintained in tension by a rim connected to a drum shell, such as by lugs. A component driver similar to a loudspeaker driver inside the shell has a vibratable surface connected, either directly or by a gel sheet, to the inside surface of the drum head to maintain contact between the drum head and the vibratable surface.

The driver may comprise a second vibratable surface with a voice coil supported in a magnetic field connected to both vibratable surfaces, for providing an electrical signal representative of the impact of a drumstick on the drum head to typically a musical instrument digital interface (MIDI).

According to another aspect of the invention, a component driver similar to either a dynamic or an electret microphone capsule is positioned in the interior of the drum shell such that there is an air plenum between the microphone diaphragm and the drum head. This plenum creates an air spring through which energy transfers from the drum head to the diaphragm.

According to another aspect of the invention, a microphone component driver is included in a housing that can be inserted into an air vent in the shell of a conventional acoustic drum. The microphone registers pressure changes in the drum interior resulting from the drum head being struck.

Striking the drum produces a voltage change in the driver linearly proportional to the force of striking. Thus the electronic output of the drum is proportional to the force of striking as is the output of an acoustical drum. Furthermore, the acoustic drum head provides a stick feel which is similar to that of an acoustic drum, the drum head outer surface constructed and arranged to present substantially the same resistive forces to drum sticks when struck presented by an acoustic drum correspondingly struck.

Other features, objects, and advantages of the invention will become apparent from the following description when read in connection with the accompanying drawings in which.

Figure 1:
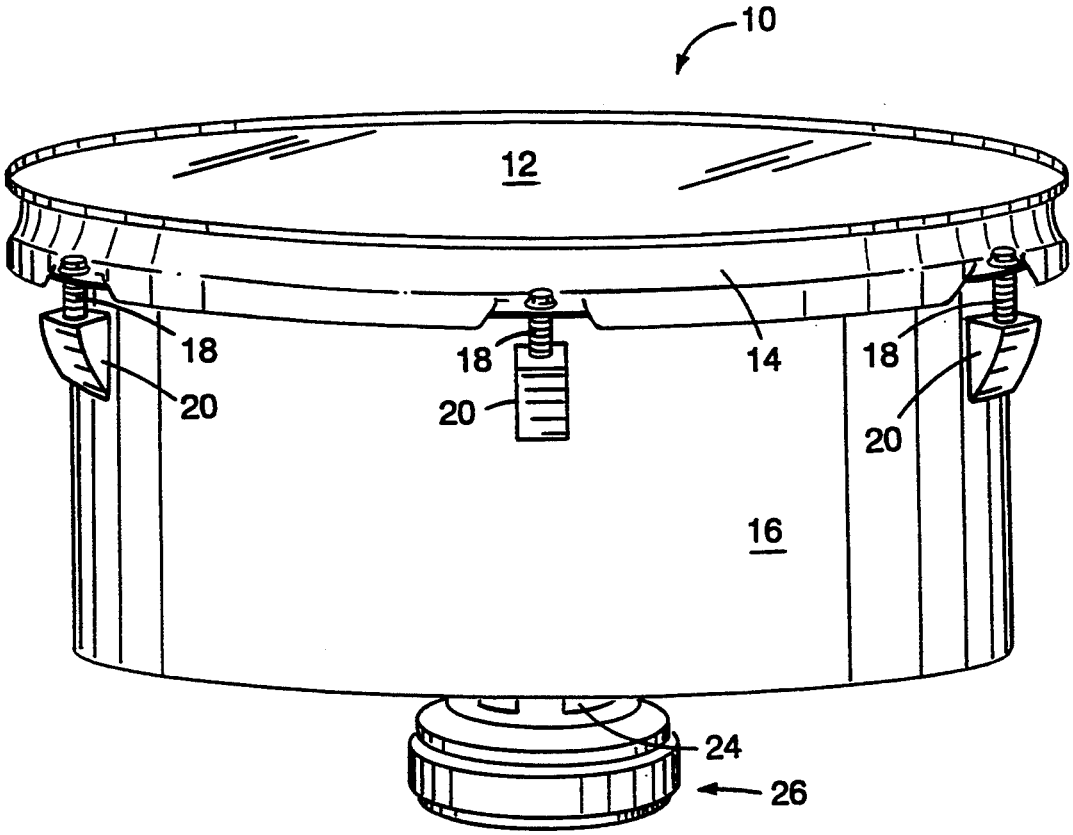
FIG. 1 is a pictorial view of a drum according to the invention.
Figure 2:
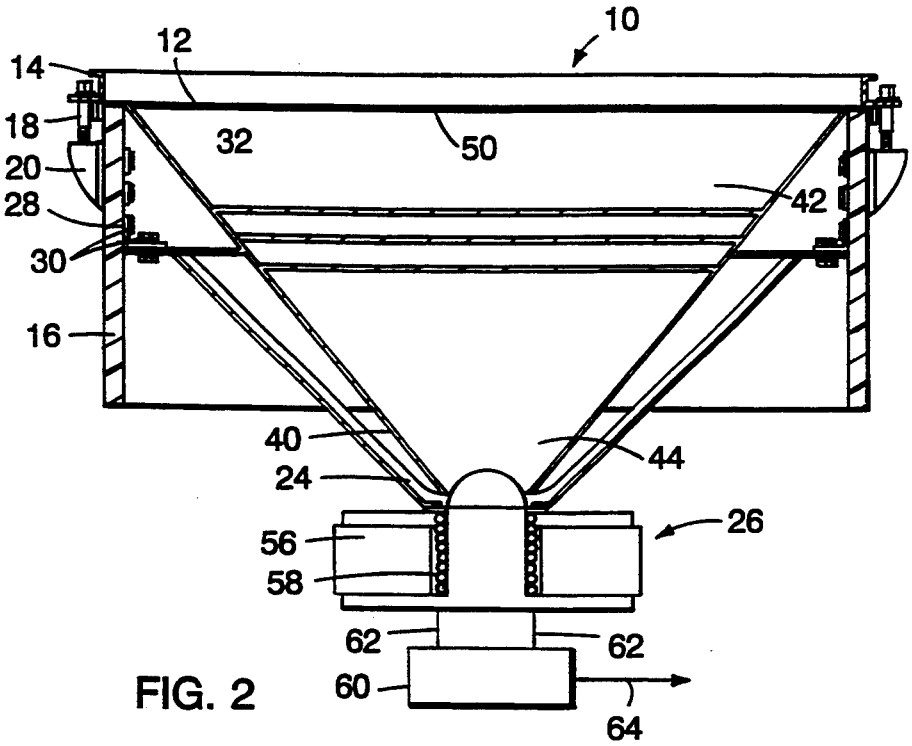
FIG. 2 is a cross-sectional view of the drum of FIG. 1.

Referring to FIG. 1, drum 10 includes a circular drum head 12 mounted over a cylindrically annular drum shell 16. Drum head 12 has an outside surface 12A and an inside surface 12B (FIG. 2). Annular drum rim 14 of L-shaped cross-section embraces and maintains in tension drum head 12. Threaded lugs 18 pass through holes in rim 14 and screw into mounts 20 attached to shell 16. Driver 24 supports shell 16.

Referring to FIG. 2, L-shaped brackets 28 and bolts 30 connect driver 24 to shell 16 adjacent to bolts 32 which interconnect shell 16 and mounts 20. Driver 24 has an outer cone 42 and inner cone 44.

The inside surface 12B of drum head 12 is connected to the annular outer rim of outer cone 42 by gel sheet 50. The diameter of drum head 12 is about equal to the diameter of outer cone 42 at the rim edge plus twice the wall thickness of shell 16. Gel sheet 50 may have adhesive on both surfaces.

Component driver 40 is mounted on base 26, which includes magnet 56 and voice coil 58 carried by a lower central portion of component driver 40. Voice coil 58 is connected by electrical leads 62 to an electronic triggering interface known as a MIDI, musical instrument digital interface.

Magnet assembly 56 is connected to basket 24A and carries voice coil 58 connected to inner cone 44. Leads 62 connect voice coil 58 to MIDI 60 to provide a signal on line 64 characteristic of the impact on drum head 12.

Figure 3:
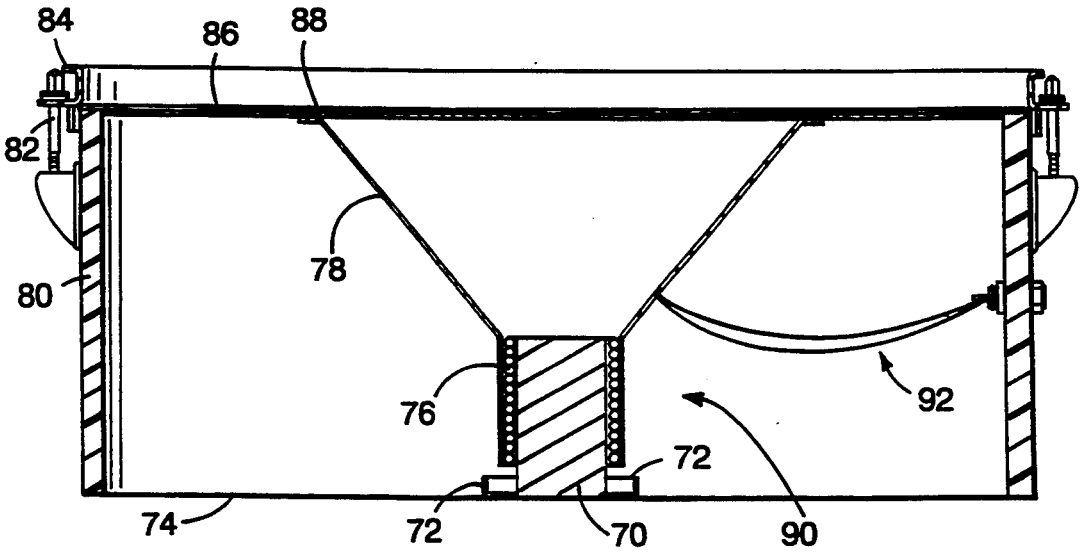
FIG. 3 is a cross-sectional view of an alternate embodiment of the drum of this invention.

Referring to FIG. 3, base 90 is contained within drum shell 80. Magnet 70 is contained within voice coil 76, and is supported by flanges 72. The bottom 74 of drum shell 80 is made of plastic or similar material. Lead wires 92 are connected to single speaker cone 78. Drum head 88 and gel sheet 86 are connected to drum rim 84 by threaded lugs 82.

Figure 4A:
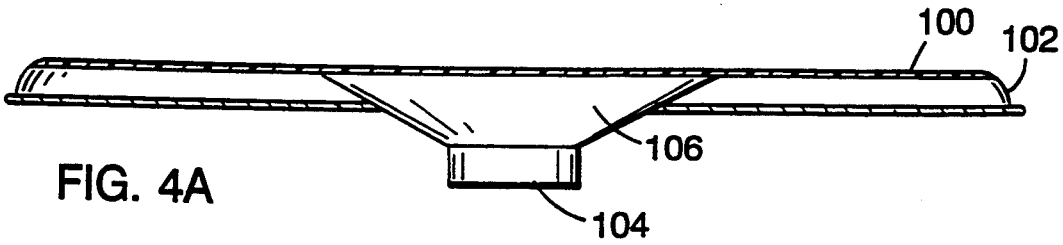
FIGS. 4A and 4B are diagrammatic views showing alternate embodiments of the invention using microphones.

Referring to FIG. 4A, gel sheet 100 is above drum head 102. Microphone 104 is connected to cone 106. Microphone 104 is an electret microphone which is used in place of the magnets and voice coils of the previously described embodiments.

Figure 4B:
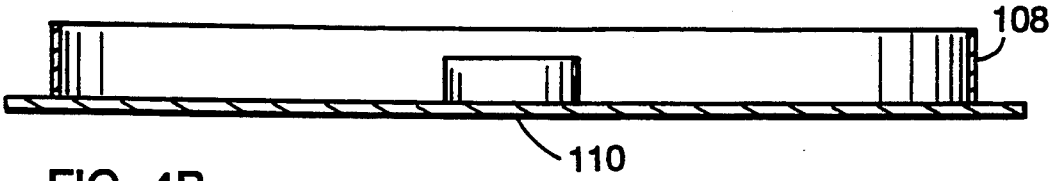

Referring to FIG. 4B, there is shown a diagrammatic view of an alternate embodiment with microphone 110 displaced from gel sheet 100 and drum head 102.

Figure 5:
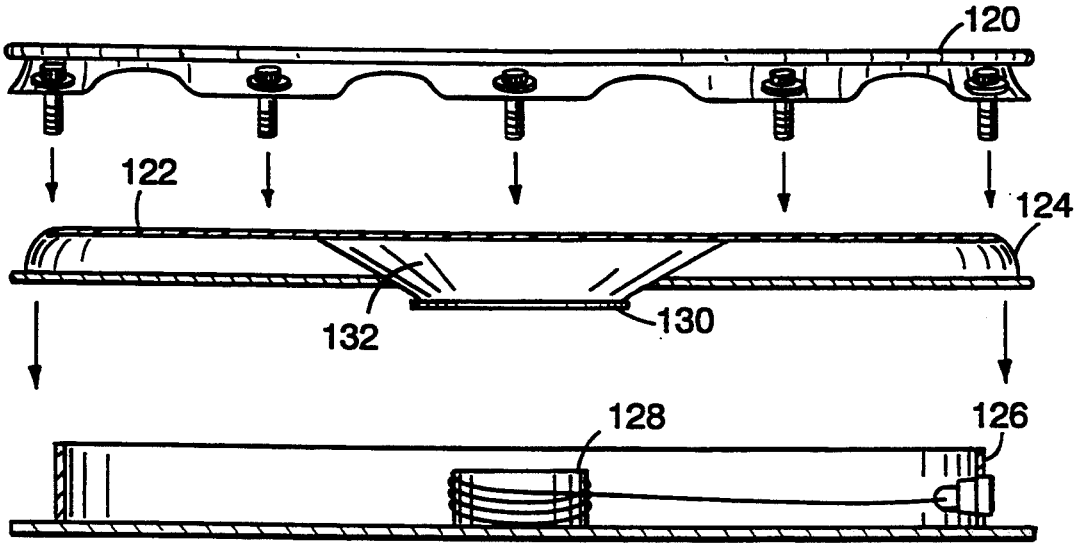
FIG. 5 is an exploded cross-sectional view of still another alternate embodiment of the drum of this invention.

Referring to FIG. 5, hoop 120 is shown apart from drum head 124 and gel sheet 122. Paper cone 132 is connected to metal foil 130. Shell 126 contains inductor 128 within it. Inductor 128 includes a magnet. The hoop assembly is placed on the drum head assembly, which is placed on shell 126. There is a gap between metal foil 130 and inductor 128. Metal foil 130 vibrates and varies the inductance of inductor 128 to provide an output signal.

Figure 6A:
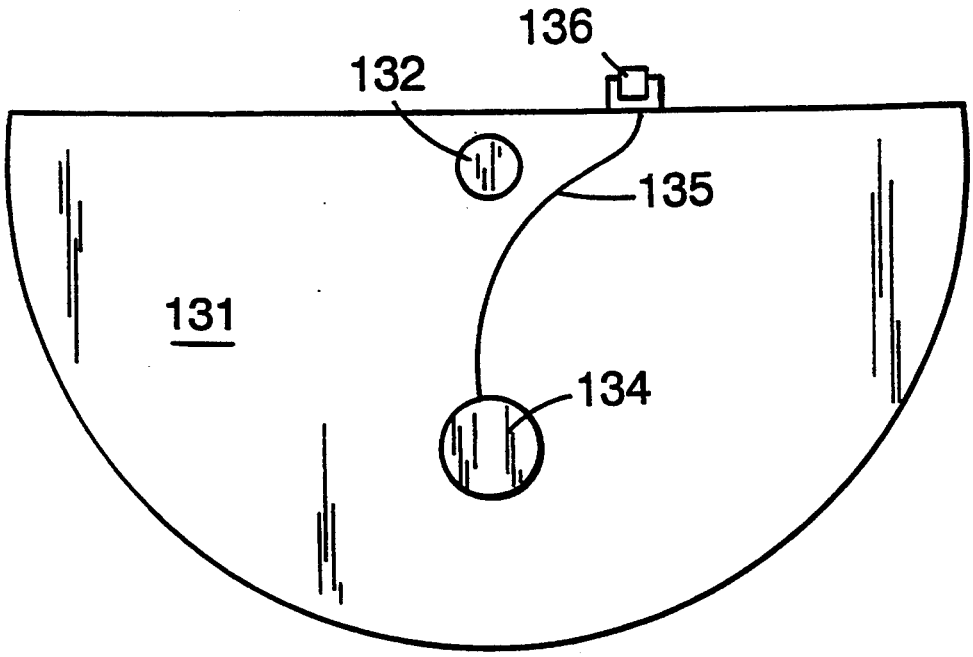
FIGS. 6A and 6B are partial plan and elevation diagrammatic views, respectively, of another embodiment of the invention using an electromagnetic transducer and a damping pad.
Figure 6B:
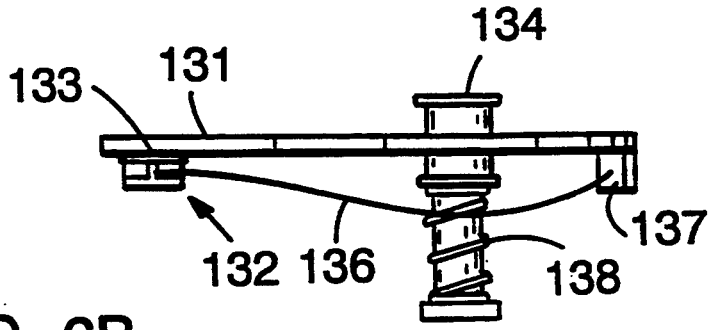

Referring to FIGS. 6A and 6B, there are shown diagrammatic plan and elevation views, respectively, of alternate embodiments of the invention. Drum head 131 carries a damping pad 132 secured to drum head 131 by adhesive tape 133 having adhesive on both sides. The output of electromagnetic transducer 134 is coupled by line 135 to output jack 136. A metal ribbon of ferromagnetic material 136 may be arranged as shown connected at 137 and biased by spring 138 to vary the inductance of electromagnetic transducer 134 in response to drum head 131 being struck.

Figure 7:
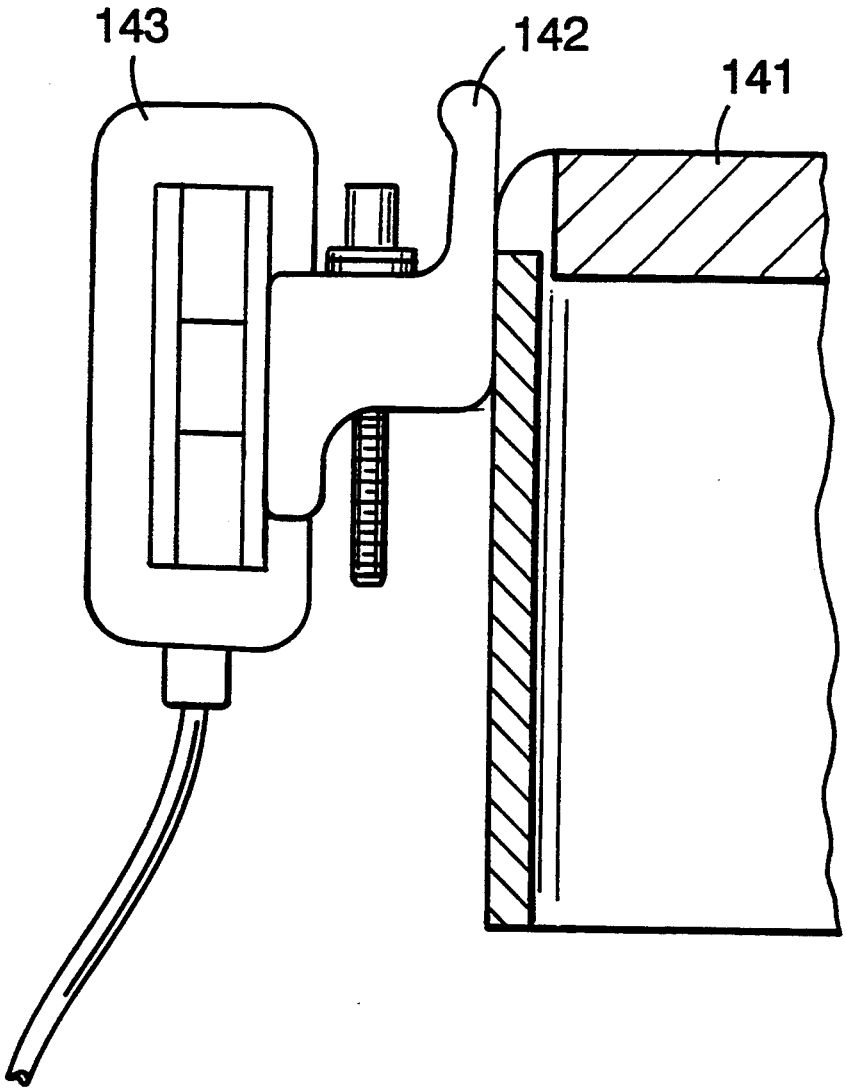
FIG. 7 is a fragmentary elevation view partially in section of an alternate embodiment of the invention using an electromagnetic pickup secured to the drum rim.

Referring to FIG. 7, there is shown a fragmentary diagrammatic view partially in section of another embodiment of the invention. Drum head 141 contacts drum rim 142 which carries electromagnetic pickup 143 that senses vibrations of drum rim 142 to furnish an output voltage representative of the force upon drum head 141.

Figure 8:
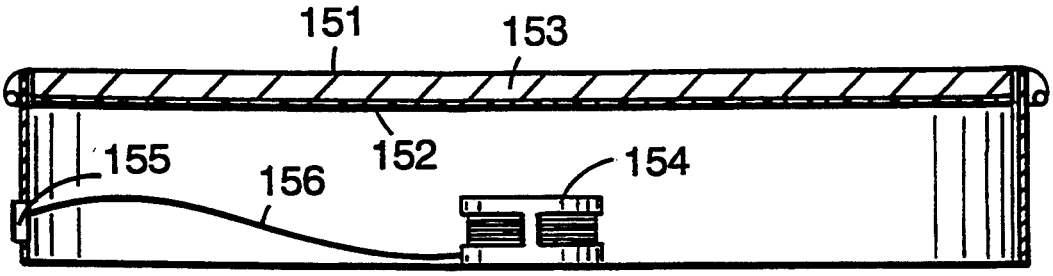
FIG. 8 is a diagrammatic sectional view of another embodiment of the invention.

Referring to FIG. 8, there is shown a diagrammatic sectional view of another embodiment of the invention with drum head 151 separated from metal foil 152 by a gel or foam damping layer 153. Transducer 154 provides an output signal to output jack 155 over line 156 that is linear with respect to drum head velocity.

Figure 9:
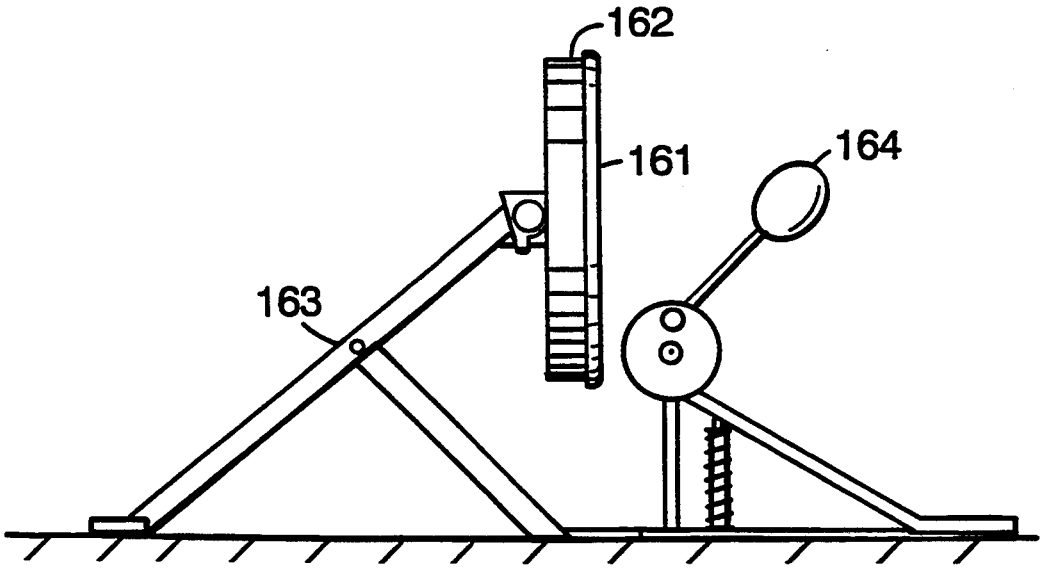
FIG. 9 is a diagrammatic representation of another embodiment of the invention with the drum head struck by a foot-operated beater.

Referring to FIG. 9, there is shown another embodiment of the invention in which the plane of the drum head 161 is in the vertical plane with drum 162 supported by stand 163. Foot-operated beater 164 strikes drum head 161.

Figure 10:
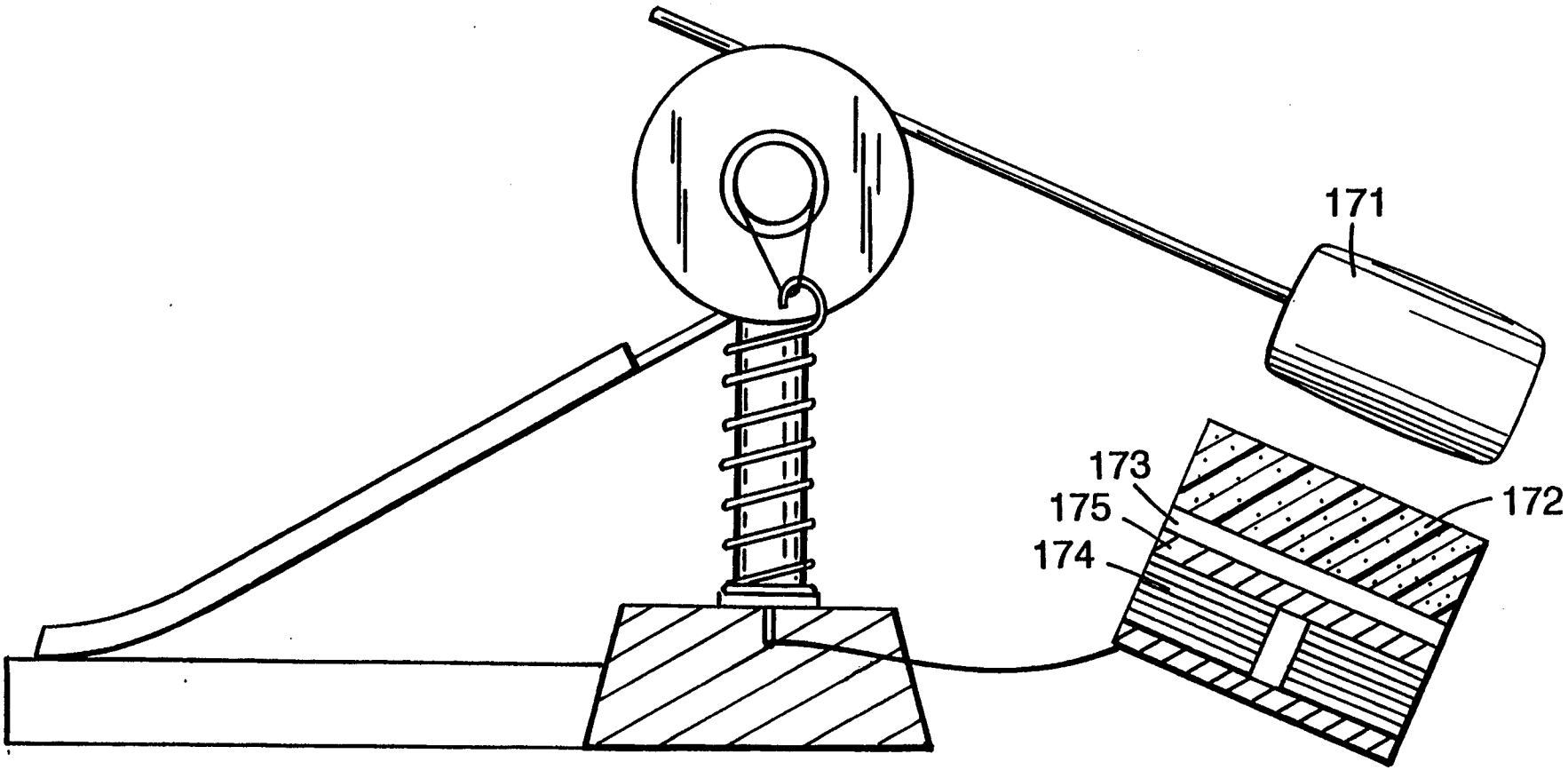
FIG. 10 is a diagrammatic representation of another embodiment of the foot-operated practice system according to the invention.

Referring to FIG. 10, there is shown a diagrammatic view partially in section of another embodiment of the invention using a foot-operated beater 171 that strikes gel or foam pad 172 backed by metal foil 173 of ferromagnetic material separated from coil 174 by air gap 175.

Figure 11:
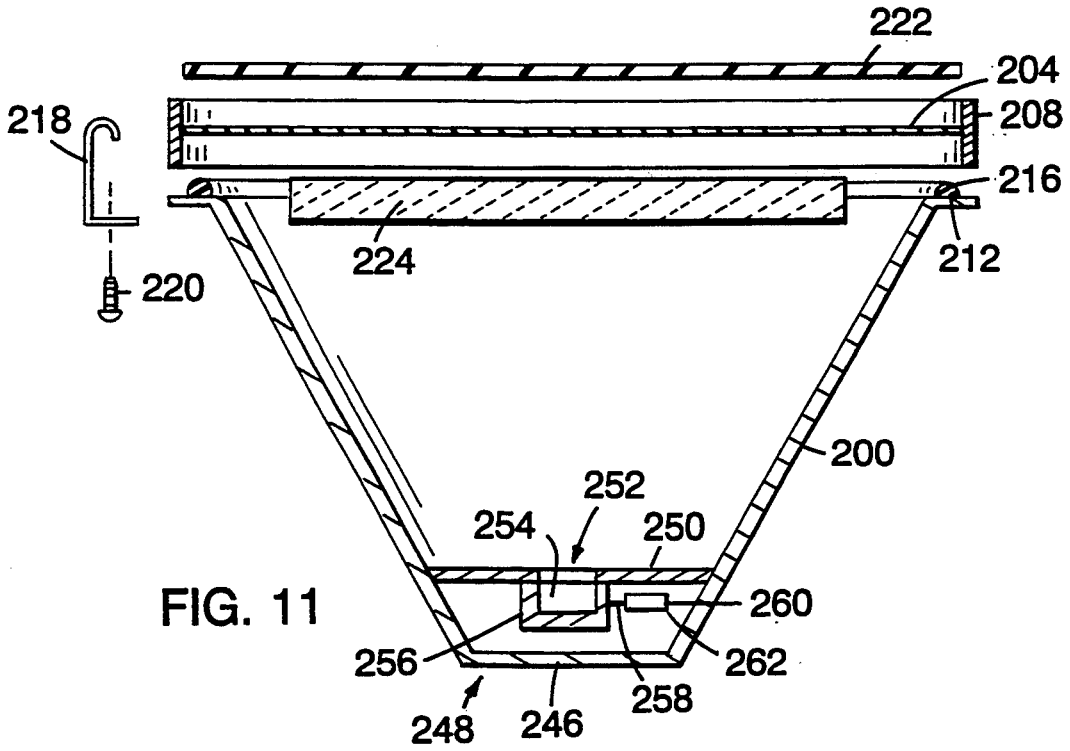
FIG. 11 is an exploded cross-sectional view of an alternate embodiment of the invention using an air spring and an electret microphone.
Figure 12:
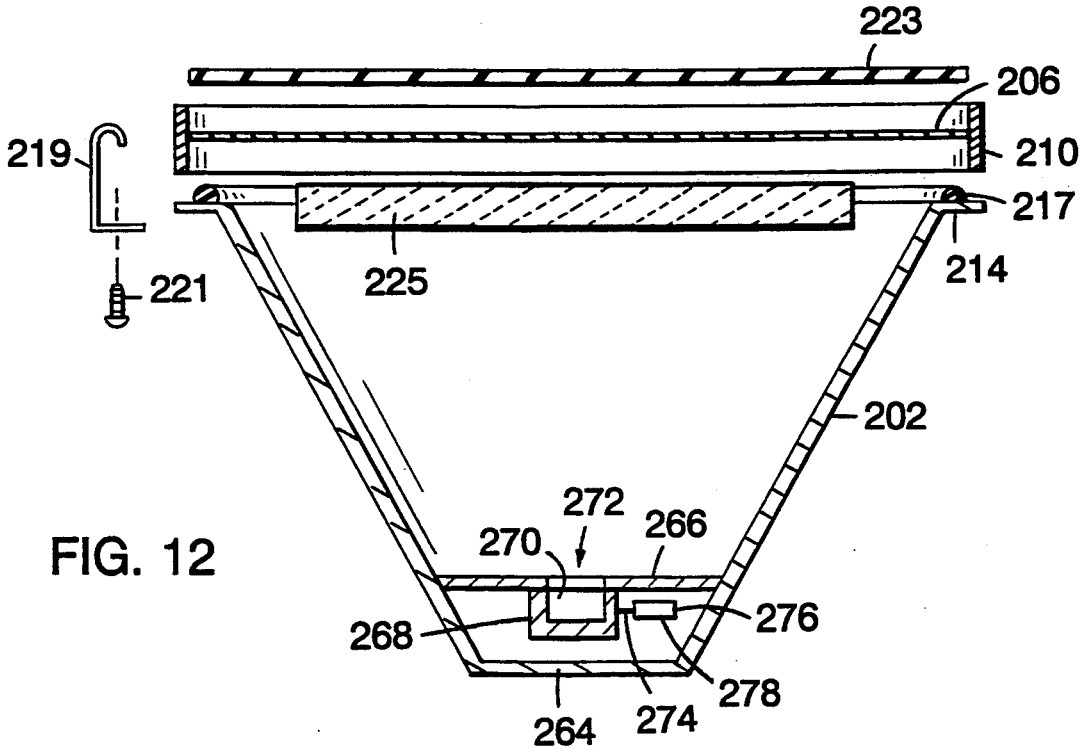
FIG. 12 is an exploded cross-sectional view of an alternate embodiment of the invention using an air spring and a dynamic microphone.

Referring to FIGS. 11 and 12, there are shown exploded cross-sectional views of two other embodiments of the invention. In both of these embodiments, frusto-conical baskets 200, 202 define interior frusto-conical air plenums. Pretuned drum heads 204, 206 are each fixed within the radially inner region of a cylindrical drum head retainer 208, 210. The diameter of the drum heads 204, 206 (and therefore the inner diameter of the drum head retainers 208, 210) approximately equals the large diameter of the basket, plus two times the width of an annular flange 212, 214 encircling the large-diameter end of each basket 200, 202. A gasket 216, 217 is positioned between the outer circumferential region of each drum head 204, 206 and flange 212,214. Each drum head/retainer assembly attaches to flange 212, 214 using equally circumferentially spaced clips 218, 219. Positioning clips 218,219 and tightening the associated screws 220, 221 forces the outer circumferential region of each drum head 204, 206 against its associated gasket 216, 217, forming an airtight seal. Optionally, either a removable 0.060" natural rubber sheet 222, 223 can be attached to the outer surface of each drum head 208, 210, and/or polyester filler 224, 225 can be placed in the frusto-conical air plenums.

Figure 13:
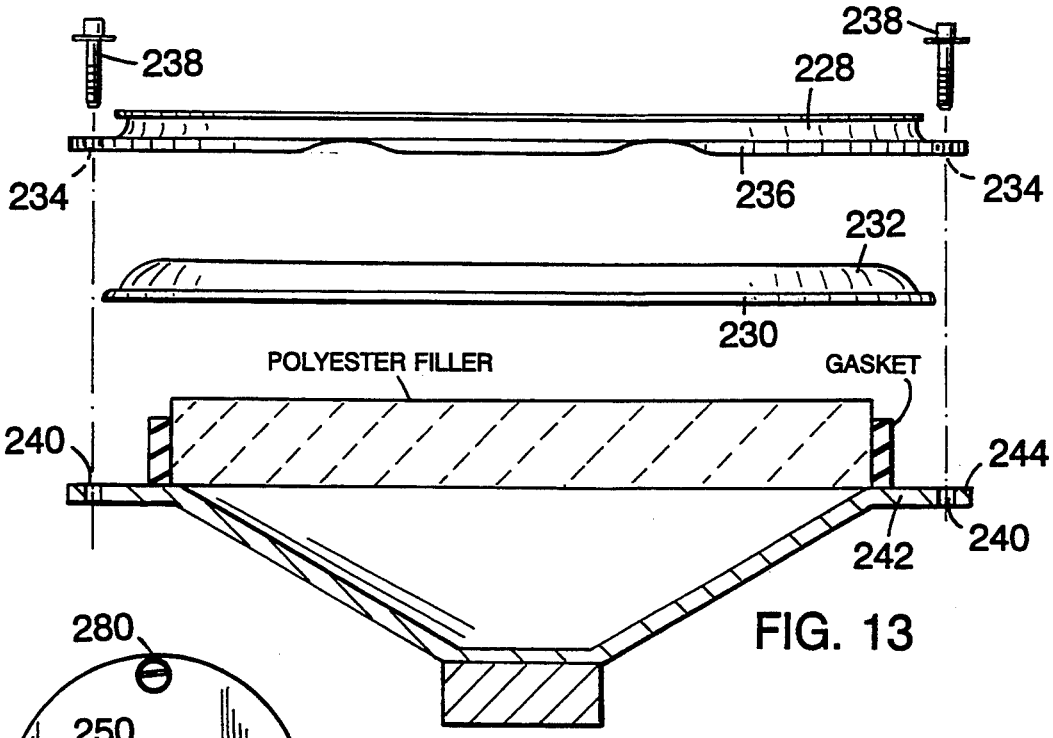
FIG. 13 is an exploded cross-sectional view of an alternate embodiment of the invention using a tunable drum head.

Alternatively, the drum can be fitted with a tunable head. As shown in FIG. 13, a hoop 228 of L-shaped cross-section engages a flange 230 encircling the outer circumference of a drum head 232. Holes 234 pass through a flange portion 236 of hoop 228 at regularly spaced circumferential intervals. Tension rods 238 inserted through these hoop holes 234 engage mating holes 240 in a flange 242 of a basket 244. Only the distal portion of each tension rod 238 is threaded. Applying different torques to the tension rods 238 varies the loading around the circumference of the drum head 232, changing the frequency characteristics of the instrument.

Referring again to FIG. 11, a back wall 246 encloses the small-diameter end 248 of basket 200. An orifice plate 250 located within the interior of the basket 200 and oriented parallel to the drum head 204 defines an orifice 252 concentric with the axis of the basket 200. An electret microphone component driver 254 is located concentric with orifice 252. A cap 256 encloses the portion of electret microphone component driver 254 disposed closest to the back wall 246 of basket 200. The input leads 258 of electret microphone 254 connects to a battery 260, and the output leads 262 to a MIDI (not shown).

Referring again to FIG. 12, a back wall 264, an orifice plate 266, and a cap 268 are all oriented as described in connection with FIG. 11. A dynamic microphone component driver 270 is located concentric with orifice 272 in orifice plate 266. Dynamic microphone 270, available from JEMA, has been modified by increasing the number of turns in the voice coil (not shown) to raise the impedance to 600 ohms. The output leads 274 from this voice coil connect to a step-up transformer 276 having a ratio between 1:8 and 1:6. Step-up transformer 276 has a generally flat frequency response between 20 Hz and 10 kHz. The outputs leads 278 from transformer 276 connect to a MIDI (not shown).

Figure 14:
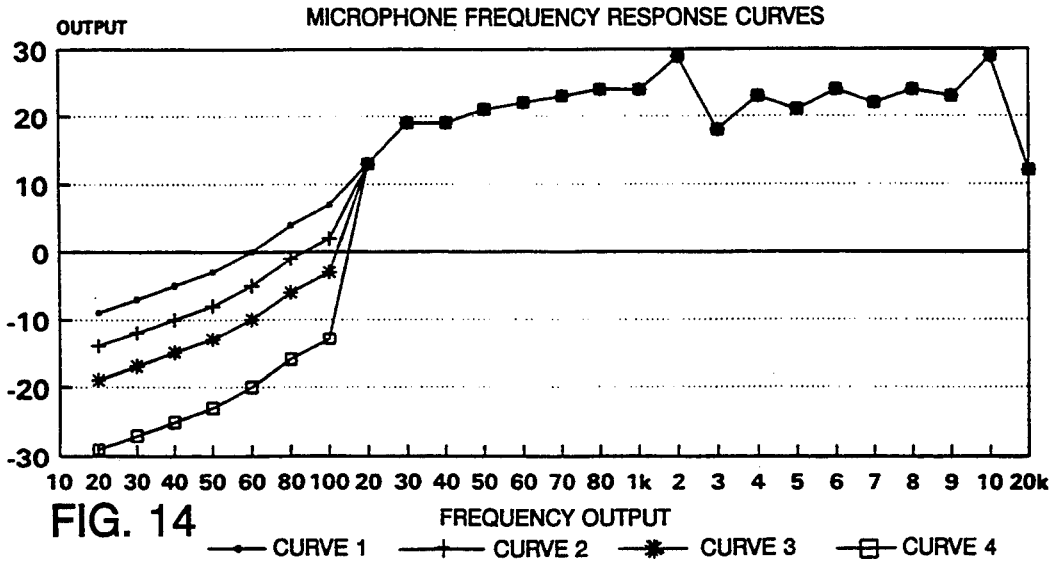
FIG. 14 shows four frequency response curves for dynamic microphone assemblies used in conjunction with the invention.
Figure 15:
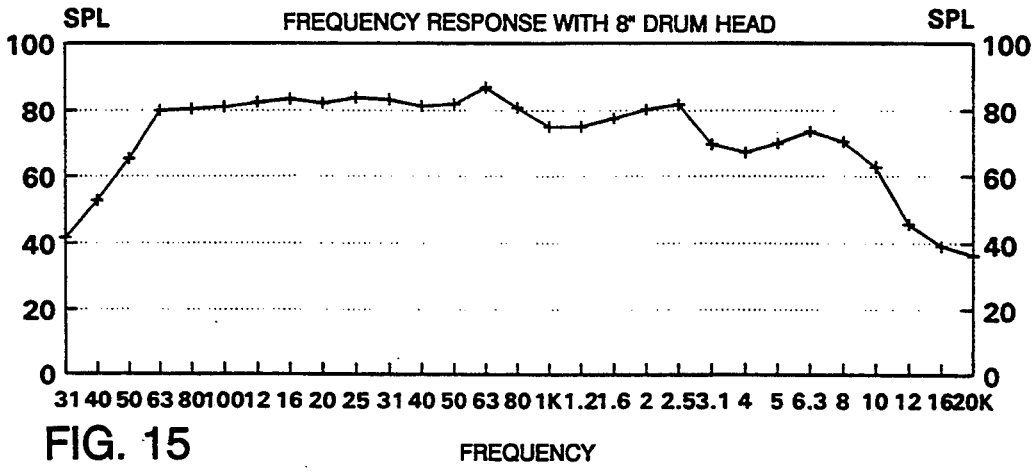
FIG. 15 is a sound power level frequency response curve of a drum according to the invention using a microphone having the frequency response curve shown in curve 1 of FIG. 14.

The frequency response of dynamic microphone 270 is shown in curve 1 of FIG. 14. As shown, dynamic microphone 270 attenuates frequencies below about 60 Hz. These frequency response characteristics make dynamic microphone 270 suitable for use with drum heads 6", 8", 10", and 12" in diameter. Using dynamic microphone 270 in a drum having an 8" diameter drum head results in the sound power level (SPL) frequency response curve shown in FIG. 15. If output leads 278 of transformer 276 are connected to a MIDI designed to accept 60k ohm impedance, dynamic microphones having the frequency responses shown in curves 2, 3, and 4 of FIG. 14 could instead be used with drum heads 10", 12", and 14" in diameter, respectively. Additionally or alternatively, the output of a dynamic microphone could be filtered using one or a series of high- and/or band-pass filters (not shown) in order to achieve the desired frequency response.

Figure 16:
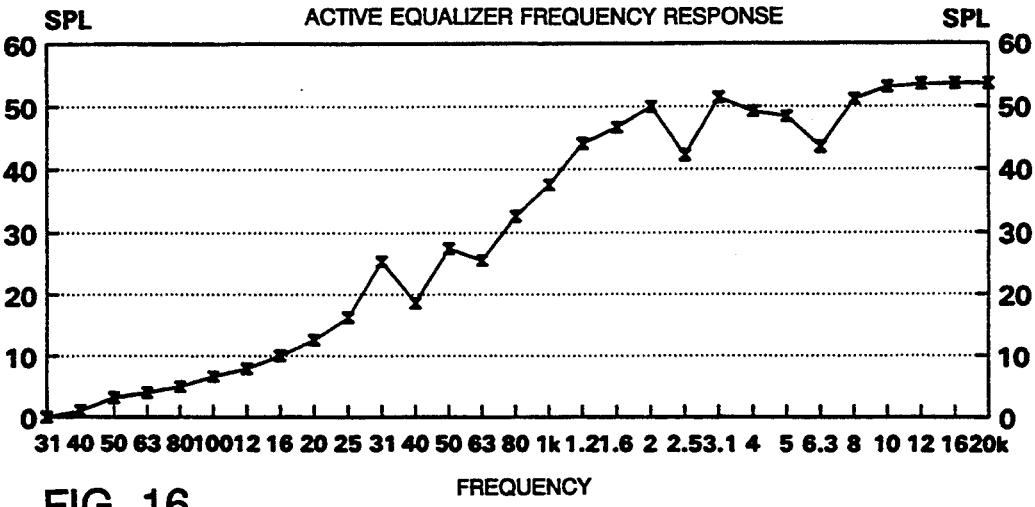
FIG. 16 is a frequency response curve for an active equalizer used in conjunction with the invention.

Alternatively, the output of a microphone could be connected to an active equalizer (not shown) that boosts frequency in accordance with the frequency response curve shown in FIG. 16. As shown, the SPL of the boost provided by the active equalizer increases generally proportionally with frequency.

Figure 17A:
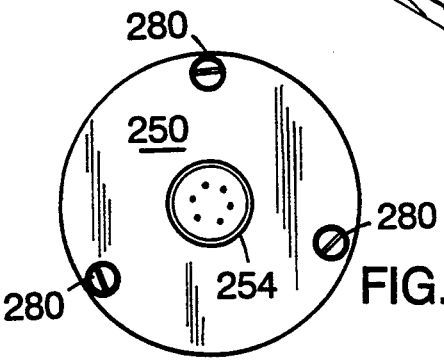
FIGS. 17A and 17B are plan and cross-sectional diagrammatic views, respectively, showing an isolation mounting for the transducer of the invention.
Figure 17B:
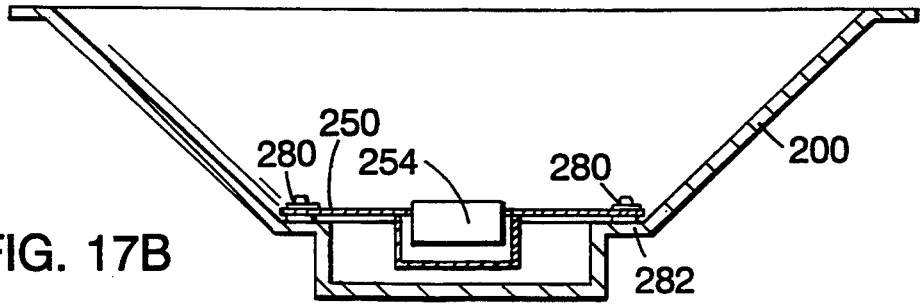

Referring to FIGS. 17A and 17B, there are shown diagrammatic plan and cross-sectional views, respectively, of an isolation mount for the orifice plate 250 shown in FIG. 11. Grommets 280 are inserted into holes provided at equal circumferential intervals around the outer circumference of orifice plate 250. For example, as shown in FIG. 17A these holes are spaced at 120 degree intervals, such that they define the corners of an equilateral triangle. The grommets 280 are constructed of C-1000 material, available from E-A-R Specialty Composites. Any grommet having a low durometer and load capacity and a resonant frequency below about 30 Hz when loaded to 5% compression is also suitable for mounting and isolation purposes. The orifice plate 250 and electret microphone component driver 254 assembly is installed by bolting it to a shoulder region 282 of basket 200, such that the grommets 280 contact directly this shoulder region 282. A similar isolation mount (not shown) is used to attach the orifice plate 266 shown in FIG. 12 to basket 202.

Figure 18:
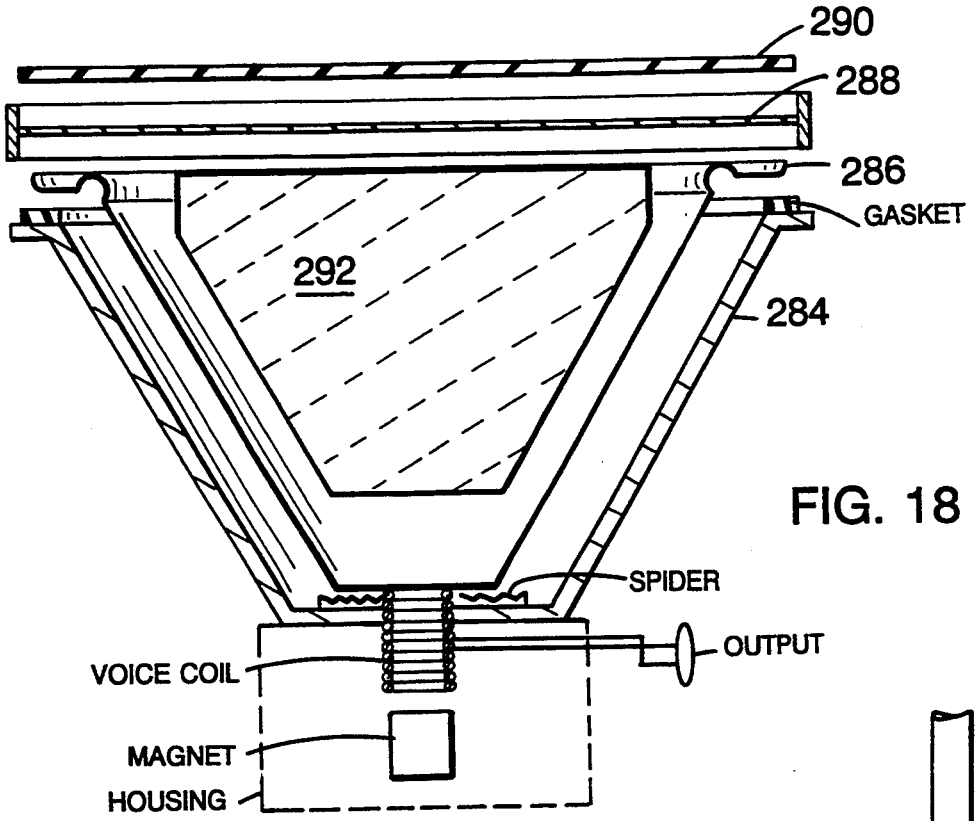
FIG. 18 is an exploded cross-sectional view of an alternate embodiment of the invention using a loudspeaker.

Referring to FIG. 18, there is shown an exploded cross-sectional view of another embodiment of the invention. This embodiment is similar in configuration to the embodiments shown in FIGS. 11 and 12, except that a basket 284 houses a loudspeaker cone 286, and there is no orifice plate. The large-diameter portion of the cone 286 contacts directly the outer circumferential region of a drum head 288. Striking drum head 288 vibrates cone 286 to generate an output signal. Optionally, either a removable 0.060" natural rubber sheet 290 can be attached to the outer surface of the drum head 288, and/or polyester filler 292 can be placed within the interior of cone 286.

Figure 19:
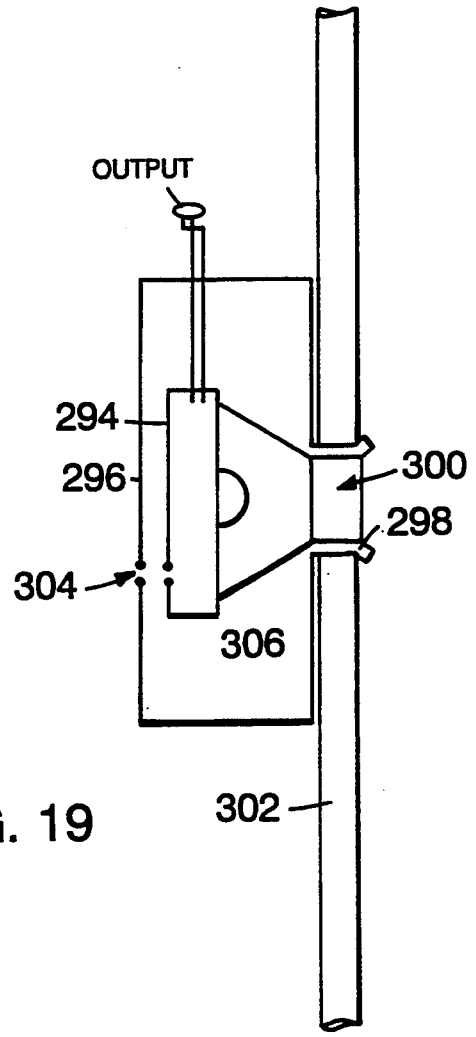
FIG. 19 is a cross-sectional view of an alternate embodiment of the invention using an enclosed microphone in pressure communication with the interior of a conventional acoustic drum.

Referring to FIG. 19, there is shown a cross-sectional view of another embodiment of the invention. A microphone 294 is located within a rubber housing 296. One portion of the housing forms an annular rubber plug 298, sized to be inserted snugly into an air vent 300 in the shell 302 of a conventional acoustic drum. A pressure equalization port 304 located in the housing 296 vents the back side of the microphone 294 to atmosphere. Striking the drum causes the head to oscillate, which in turn causes the pressure in the drum interior to fluctuate. The resulting pressure differential across the microphone diaphragm 306 causes it to vibrate and generate an output signal.

The invention has a number of advantages. Striking the drum head provides an output signal representative of the force signal applied to the drum head that may be reproduced through an amplifying and transducing system to provide a sound accurately corresponding to the sound produced by an acoustic drum receiving the same impact. An advantage of the particular structural arrangement is that a musician striking drum head 12 perceives substantially the same feel on the drum sticks perceived when striking an acoustic drum.

In operation, if a drummer strikes the drum with a stick, the stick feeling is similar to that of an acoustic drum. Striking the drum head 12 creates a voltage change linear to the force on the drum head, thus providing a consistent response relative to the force of striking. MIDI 60 receives the voltage from the component driver and converts the voltage to an output signal 64 recognizable to instruments used with the MIDI.

A drum according to the invention also attenuates noise in the component driver output signal resulting from both "double triggering" effects and extraneous vibration. Double triggering occurs when spurious vibrations remaining after the head is struck continue to trigger the component driver, which results in a chain of repetitive sounds. Extraneous vibration is an issue both during live performances, where volume levels are often quite high, and in the studio, where multiple triggers are often spaced closely enough to cause cross-talk problems.

Furthermore, by incorporating the invention into a plug that may be inserted into the shell of a conventional acoustic drum, the benefits of preserved stick feel and MIDI-suitable output are realized without requiring the musician to purchase and adapt to new instruments.

Other embodiments are within the claims.

What is claimed is:

1. An electroacoustical drum, comprising:

a drum shell;

a drum head having an outside surface and an inside surface;

a fastening assembly securing said drum head to said drum shell with said drum head in tension;

a transducer having a voice coil and a vibratable surface formed with an annular outer rim and a lower central portion carrying said voice coil, so that vibration of said vibratable surface produces a corresponding electrical signal from said voice coil; and a connecter connecting the annular outer rim of said vibratable surface to an annular portion of the inside surface of said drum head adjacent to said drum shell so that striking the outer surface of said drum head with a drumstick produces a corresponding electrical signal from said voice coil while allowing a musician striking the drum head outer surface with drumsticks to perceive substantially the same feel perceived by correspondingly striking an acoustic drum, the drum head outer surface constructed and arranged to present substantially the same resistive forces to drumsticks when struck presented by an acoustic drum correspondingly struck.

2. An electroacoustical drum in accordance with claim 1, wherein said transducer comprises a voice coil and a magnet assembly with said vibratable surface connected to said voice coil and said voice coil supported in said magnet assembly.

3. An electroacoustical drum in accordance with claim 1, wherein said transducer comprises a voice coil and a magnet assembly with said vibratable surface connected to said voice coil and said magnet contained within said voice coil.

4. An electroacoustical drum in accordance with claim 1 wherein said connecter comprises a gel sheet.

5. An electroacoustical drum comprising, a drum shell, a drum head having an outside surface and an inside surface, a fastening assembly securing said drum head to said drum shell with said drum head in tension, cone structure formed with an annular outer rim and a lower central portion, an electroacoustical transducer carried by said lower central portion so that vibration of said cone structure produces a corresponding electrical signal from said electroacoustical transducer, the annular outer rim of said cone structure being connected to an annular portion of the inside surface of said drum head adjacent to said drum shell so that striking the outer surface of said drum head with a drumstick produces a corresponding electrical signal from said electroacoustical transducer while allowing a musician striking the drum head outer surface with drumsticks to perceive substantially the same feel perceived by correspondingly striking an acoustic drum, the drum head outer surface constructed and arranged to present substantially the same resistive forces to drumsticks when struck presented by an acoustic drum correspondingly struck.

6. An electroacoustical drum in accordance with claim 5, wherein said electroacoustical transducer is a microphone.

7. An electroacoustical drum in accordance with claim 6, wherein said microphone is an electret microphone.

8. An electroacoustical drum in accordance with claim 5 wherein said cone structure comprises a single cone.

9. An electroacoustical drum in accordance with claim 8 wherein said cone is a paper cone.

10. An electroacoustical drum in accordance with claim 5 wherein said cone structure comprises an outer cone having said outer rim and an inner cone interconnecting said outer cone and said electroacoustical transducer.

11. An electroacoustical drum in accordance with claim 5 and further comprising a gel sheet connecting said cone structure to the inside surface of said drum head.

12. An electroacoustical drum, comprising:

a drum shell;

a drum head having an outside surface and an inside surface;

a fastening assembly securing said drum head to said drum shell with said drum head in tension;

a transducer having a vibratable surface formed with an annular outer rim, so that vibration of said vibratable surface produces a corresponding electrical signal; and a connecter connecting the annular outer rim of said vibratable surface to an annular portion of the inside surface of said drum head adjacent to said drum shell so that striking the outer surface of said drum head with a drumstick causes said vibratable surface to vibrate while allowing a musician striking the drum head outer surface with drumsticks to perceive substantially the same feel perceived by correspondingly striking an acoustic drum, the drum head outside surface constructed and arranged to present substantially the same resistive forces to drumsticks when struck presented by an acoustic drum correspondingly struck.

13. An electroacoustical drum in accordance with claim 12, wherein said transducer comprises a voice coil and a magnet assembly with said vibratable surface connected to said voice coil and said voice coil supported in said magnet assembly.

14. An electroacoustical drum in accordance with claim 12, wherein said transducer comprises a voice coil and a magnet assembly with said vibratable surface connected to said voice coil and said magnet contained within said voice coil.

15. An electroacoustical drum in accordance with claim 12, wherein said connector is a cone.

16. An electroacoustical drum in accordance with claim 15 wherein said cone is a paper cone.

17. An electroacoustical drum in accordance with claim 12, and further including damping material for noise attenuation.

18. An electroacoustical drum in accordance with claim 17, wherein said damping material is polyester fill disposed between said inside surface of said drum head and said vibratable surface.

19. An electroacoustical drum in accordance with claim 18, wherein said damping material further includes a natural rubber sheet attached to said outside surface of said drum head.

20. An electroacoustical drum in accordance with claim 12, and further including an isolation mounting.

21. An electroacoustical drum in accordance with claim 20, wherein said isolation mounting comprises a plurality of resilient members disposed between said transducer and said drum shell.

22. An electroacoustical drum in accordance with claim 21, wherein each of said resilient members when installed has a resonant frequency below substantially 30 Hz.

23. An electroacoustical drum in accordance with claim 21, wherein said resilient members are grommets constructed of heavily damped vinyl.

24. An electroacoustical drum, comprising:

a drum head having an outside surface and an inside surface;

a transducer having a vibratable surface, so that vibration of said vibratable surface produces a corresponding electrical signal;

a body defining a frusto-conical plenum disposed between said inside surface of said drum head and said vibratable surface such that striking the outer surface of said drum head with a drumstick causes said vibratable surface to vibrate while allowing a musician striking the drum head outer surface with drumsticks to perceive substantially the same feel perceived by correspondingly striking an acoustic drum; and a fastening assembly fixing the position of said drum head with respect to said body with said drum head in tension, the drum head outside surface constructed and arranged to present substantially the same resistive forces to drumsticks when struck presented by an acoustic drum correspondingly struck.

25. An electroacoustical drum in accordance with claim 24, wherein said frusto-conical plenum has a large-diameter end and small-diameter end and said fastening assembly is located at the large-diameter end of said plenum and said transducer is located at the small-diameter end of said plenum.

26. An electroacoustical drum in accordance with claim 24, wherein said transducer comprises a microphone.

27. An electroacoustical drum in accordance with claim 26, wherein said microphone is an electret microphone.

28. An electroacoustical drum in accordance with claim 26, wherein said microphone is a dynamic microphone.

29. An electroacoustical drum in accordance with claim 28, wherein said dynamic microphone attenuates low-frequency signals.

30. An electroacoustical drum in accordance with claim 28, wherein said dynamic microphone attenuates signals below substantially 60 Hz.

31. An electroacoustical drum in accordance with claim 24, and further including a band-pass filter for filtering said electrical signal.

32. An electroacoustical drum in accordance with claim 24, and further including an active equalizer for boosting selected frequencies of said electrical signal.

33. An electroacoustical drum in accordance with claim 32, wherein said active equalizer boosts higher selected frequencies of said electrical signal by a greater magnitude than lower selected frequencies of said electrical signal.

34. An electroacoustical drum in accordance with claim 24 wherein said plenum has an axis, and further including an orifice plate disposed within said plenum and oriented parallel to said drum head, said orifice plate defining an orifice concentric with the axis of said plenum.

35. An electroacoustical drum in accordance with claim 24, and further including damping material for noise attenuation.

36. An electroacoustical drum in accordance with claim 35, wherein said damping material is polyester fill disposed between said inside surface of said drum head and said vibratable surface.

37. An electroacoustical drum in accordance with claim 36, wherein said damping material further includes a natural rubber sheet attached to said outside surface of said drum head.

38. An electroacoustical drum in accordance with claim 24, and further including an isolation mounting.

39. An electroacoustical drum in accordance with claim 38, wherein said isolation mounting comprises a plurality of resilient members disposed between said transducer and said body.

40. An electroacoustical drum in accordance with claim 39, wherein each of said resilient members when installed has a resonant frequency below substantially 30 Hz.

41. An electroacoustical drum in accordance with claim 39, wherein said resilient members are grommets constructed of heavily damped vinyl.

42. An electroacoustical acoustic drum pickup assembly, comprising:

a housing having a first port in pressure communication with atmosphere and a second port adapted to be insertable into an air vent located in the shell of said drum;

a transducer disposed within said housing and having a vibratable diaphragm, so that vibration of said vibratable diaphragm produces a corresponding electrical signal; and a first surface of said diaphragm in pressure communication with said first port, and a second surface of said diaphragm in pressure communication with said second port so that striking the drum head of said drum with a drumstick causes said vibratable diaphragm to vibrate while allowing a musician striking the drum head with drumsticks to perceive substantially the same feel perceived by correspondingly striking an acoustic drum not provided with an electroacoustical pickup assembly, the drum head outside surface constructed and arranged to present substantially the same resistive forces to drumsticks when struck presented by an acoustic drum correspondingly struck.

43. An electroacoustical acoustic drum pickup in accordance with claim 42, and further including a frusto-conical plenum disposed between said second surface of said diaphragm and said second port and having a large-diameter end and small-diameter end such that said second surface is located at the large-diameter end of said plenum.

44. An electroacoustical acoustic drum pickup in accordance with claim 42, wherein said housing is made of rubber.

45. An electroacoustical drum in accordance with claim 42, wherein said transducer is a dynamic microphone.

46. An electroacoustical drum in accordance with claim 45, wherein said dynamic microphone attenuates low-frequency signals.

47. An electroacoustical drum in accordance with claim 45, wherein said dynamic microphone attenuates signals below about 60 Hz.

48. An electroacoustical drum in accordance with claim 42, and further including a band-pass filter for filtering said electrical signal.

49. An electroacoustical drum in accordance with claim 42, and further including an active equalizer for boosting selected frequencies of said electrical signal.

50. An electroacoustical drum in accordance with claim 49, wherein said active equalizer boosts higher selected frequencies of said electrical signal by a greater magnitude than lower selected frequencies of said electrical signal.

* * * * *